United States Patent [19]

Lanfermann et al.

[11] 4,025,118

[45] May 24, 1977

[54] SPILL-PLATE APPARATUS FOR A MINING MACHINE

[75] Inventors: Willy Lanfermann; Otto Renzing, both of Bochum, Germany

[73] Assignee: Gebr. Eickhoff, Maschinenfabrik und Eisengiesserei m.b.H., Bochum, Germany

[22] Filed: Nov. 28, 1975

[21] Appl. No.: 636,306

[30] Foreign Application Priority Data

Nov. 29, 1974 Germany ..... 2456442

[52] U.S. Cl. ..... 299/43; 104/194

[51] Int. Cl.² ..... E21C 27/34

[58] Field of Search ..... 299/32, 34, 18, 43–48; 191/12 R, 25; 104/146, 155, 156, 161, 194

[56] References Cited

UNITED STATES PATENTS

| | | | |
|---|---|---|---|
| 258,564 | 5/1882 | Drake | 104/194 |
| 405,628 | 6/1889 | Van Depoele | 191/25 |
| 3,339,981 | 9/1967 | Dommann et al. | 299/34 |
| 3,861,751 | 1/1975 | Erwien | 299/34 X |

*Primary Examiner*—Ernest R. Purser
*Attorney, Agent, or Firm*—Brown, Murray, Flick & Peckham

[57] ABSTRACT

A spill-plate housing extends along one side of the course of travel by a mining machine. A flexible cutter cable and water conduit are carried from the mining machine by a carrier arm for extending into the spill-plate housing by projecting through a longitudinal slot formed in a faceplate of the housing. Upper and lower resilient apron strips are secured to the faceplate so that their longitudinal edges abut along the longitudinal center of the slot. Vertical support pipes are secured to the faceplate by upper and lower members to form an internal housing space adapted to accommodate the cable and conduit while coupled to the mining machine. Bias blocking arms are pivotally supported by the faceplate within the housing to prevent unintentional emergence of the cable from the slot in the housing. Pipe-engaging surfaces on clamp plates arranged at opposed sides of the vertical support pipes are used to carry a door for vertical movement to expose the interior of the housing space.

14 Claims, 5 Drawing Figures

SPILL-PLATE APPARATUS FOR A MINING MACHINE

BACKGROUND OF THE INVENTION

This invention relates to a side spill-plate apparatus to accommodate a cutter cable or a cutter chain which surrounds the cutter cable for a mining machine. More particularly, the present invention relates to a device for transferring a length of cable from the side spill-plate apparatus to a mining machine, particularly a cutter drum type which traverses along the length of the spill-plate housing.

It is known in the art to attach side spill plates onto the stow side of a face conveyor. The spill plates are provided with a trough-shaped trunking along the side thereof which faces away from the face conveyor. This trunking has an open top for accommodating the cutter cable or the cable chain which surrounds the cutter cable. Traversing along the side of the spill plate is the drum cutter which is provided with a projection to form the so-called cable reversing means that extends over the open top of the trunking to lift the cable from the trunking and transfer it to the mining machine where the end of the cable is connected to the frame of the drum cutter. The end of the cable chain, when it surrounds the cutter cable, is also transferred to the machine frame.

A side spill plate defines a working space at the stowing side of the face conveyor. A relatively high side spill plate must be employed when releasing material from thick coal seams because of the large muck pile that results from the winning operation. This prevents overdamping and reduces the risk of accidents. When the dimensions of the side spill plate are such that the plate projects beyond the top edge of the machine frame, it is necessary that the cable which is guided from the stow side over the spill plate is first directed downwardly and then between the spill plate and the machine body at right angles toward the latter with a very small radius. There is a specific minimum value to this bending radius because of the relatively large cable diameter. The distance between the machine frame and the side spill plate must be adapted to the minimum bending radius for the cable and, therefore, this distance must be larger than usual despite the need for minimizing this distance in order to reduce the width of the space required for the traversing movement by the mining machine. This also enlarges the area of the mine roof which must be supported.

Known forms of side spill plates are subject to certain disadvantages which arise not only when working a thick mine seam but also the known spill plates are unusable for working a mine seam which has a substantial angle of inclination. In this regard, there is the risk that the cable or cable chain will become upwardly kinked and pushed out of the cable trunking due to the resultant force component from the downwardly-oriented weight of the cable.

SUMMARY OF THE INVENTION

It is an object of the present invention to provide a side spill-plate apparatus which is suitable for use while releasing material from thick and/or inclined mine seams by providing a construction and arrangement of parts for the side spill-plate apparatus whereby the height thereof does not affect the transfer of the cutter cable to the drum cutter machine while at the same time prevents the cable as well as the cable chain from kinking even when extending along inclined mine seams.

According to the present invention, there is provided a spill-plate apparatus adapted to extend along one side of the course of travel by a mining machine having cutter means for releasing material from a mine face, the apparatus including the combination of a cable having an end connected to the mining machine while the cable extends along the course of travel by the mining machine, the housing having an internal space adapted for accommodating at least a portion of the extended length of the cable, the spill-plate housing including a faceplate with a longitudinal slot along the length of the housing and facing toward the mining machine, a carrier extending between the internal space in the housing and the mining machine for supporting the length of the cable extending through the slot in the faceplate, and shutter means for normally closing the slot in the faceplate while accommodating the carrier for the cable.

Thus, the present invention provides that the spill-plate housing has an interior for accommodating the cutter cable. The housing is constructed so that the internal area completely accommodates the cable or the cable chain. The housing is provided with a slot normally closed by a shutter and extending over the length of the spill plate at the working side of the housing. The end of the cutter cable is transferred to the drum cutter by a member projecting therefrom to open a shutter only in the region of the slot where the cutter cable emerges from the spill-plate housing. The projecting member extends through the slot. The structural height of the spill plate does not affect the transfer of the end of the cable from the side spill-plate housing when constructed in this manner. Moreover, the cable and the cable chain cannot emerge from the side spill-plate housing when the latter is employed for material-releasing operations at a substantially inclined mine seam.

According to a further feature of the present invention, weighted or spring-biased blocking elements prevent unintentional emergence of the cable from the slot in the side spill-plate housing. These blocking elements are distributed at spaced-apart locations along the length of the slot and automatically return to their blocking position after the emerging end of the cable passes each member. More particularly, as the drum cutting machine moves along its course of travel, the blocking members are deflected by the projection from the machine to the top or to the bottom of the slot so that the full height of the slot is available for the cable carrying member to pass therealong.

The blocking elements are preferably supported within the housing space by the wall having the elongated slot therein. The blocking elements are pivotally supported for displacement in the direction of the longitudinal orientation of the slot and return under spring bias to their initial position. These blocking elements are dimensioned so that they project along the height of the slot notwithstanding angular inclinations of the slot corresponding to inclinations of a mining seam. The blocking elements may be eliminated when the cutter cable is used in conjunction with a cable chain, since the links of the cable chain are usually larger than the height of the slot. Therefore, the links prevent unintentional emergence of the cutter cable since it is surrounded by the chain, thus alleviating the need for separate blocking members.

It is preferred to seal the interior of the spill-plate housing against penetration by material released from the mine face including the muck pile. In this regard, such a sealed interior is provided with respect to the working face of the mine and also toward the roof so that the projection from the drum cutter machine extends into the spill-plate housing and freely movable along the slot without obstruction by the muck pile. This also insures that the blocking elements within the spill-plate housing can be moved without obstruction. At the same time, the blocking elements are easily capable of returning to their initial position if the internal space within the spill-plate housing is free of material released from the mine face.

The apparatus of the present invention further includes an apron strip made of resilient material to extend along the length of the slot for elastic deformation by the cable support member projecting from the slot. Such an apron strip forms a seal to the slot which is impervious to penetration by the muck pile by mounting the seal along its top edge onto the spill-plate housing. If desired, the apron strip may be constructed in the form of an upper and lower apron strip which is secured, respectively, to the wall above and below the slot therein so that abutting edges of the strips extend along the length of the slot. By mounting the apron strip or divided apron strips onto the exterior wall of the spill-plate housing, the closure function of these strips is improved and permits the above-described blocking elements to be disposed on the interior surface of the spill-plate housing at a closely-adjacent relation to the slot in the housing wall. The carrier projecting from the mining machine preferably includes tapering chamfered surfaces extending from opposite sides thereof in the longitudinal direction of the slot to elastically deform the resilient material forming the apron strip while at the same time avoid damaging the apron strip in both directions of travel by the mining machine.

The spill-plate housing of the present invention includes a pair of ribs secured to and extending horizontally from the internal surface of the faceplate along the length thereof. These ribs include openings to receive vertically-extending pipes that are spaced from each other along the length of the spill-plate housing and horizontally spaced from the faceplate thereof so as to define the aforementioned interior space in the housing to accommodate the cutter cable. A cover plate supported by these pipes forms the roof of the spill-plate housing. Detachable spacer bushings extend between the faceplate and the vertical support pipes to subdivide the space in the housing into a bottom part where the cutter cable extends longitudinally along the middle portion of the spill-plate housing. The cutter cable extends through a return loop from where at the top part of the housing space, the cutter cable extends to the drum cutting machine. To facilitate the insertion or removal of the cutter cable or the cable chain, the spacer bushings are removable so that the interior space within the spill-plate housing can be enlarged.

According to a further feature of the present invention, the vertically-extending pipes are employed to support clamping members for vertical adjustments to the position of a door having a fence-like grid at the stowing side of the spill-plate housing. The vertical pipes are arranged along the length of the spill-plate housing in pairs at a reduced spacing so as to accommodate in the space between the pipes, two clamping members which are mounted by a single clamping screw. Each clamping member includes two support surfaces which are formed to correspond to the outer surfaces of the pipes for adjustable sliding movement of the door.

These features and advantages of the present invention as well as others will be more readily understood when the following description is read in light of the accompanying drawings, in which.

Figure 1:
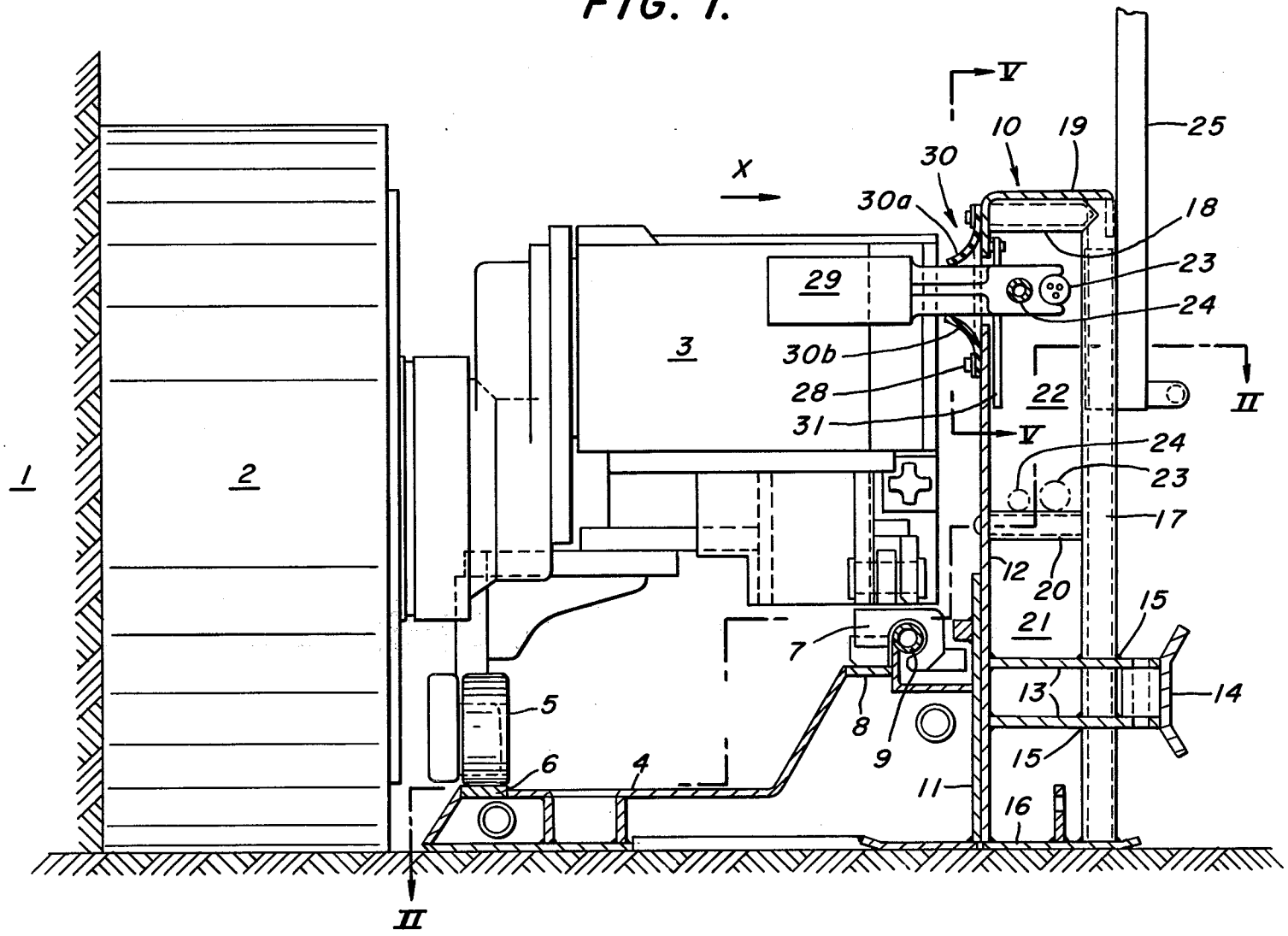
FIG. 1 is an end elevational view, in section, of the spill-plate housing apparatus according to the present invention.

FIG. 1 illustrates a mining machine in the form of a drum cutter 3 having a cutting drum 2 employed to release material from a mine seam 1 while supported upon and traversed along an angle through 4. The drum cutter machine has wheels 5 that engage a track 6 on the top face surface of the angle trough 4. The wheels 5 support the drum cutter machine at the working side thereof and at the stow side, a sled 7 is supported on a track 8 forming part of the angle trough 4. This trough further includes a tubular rail 9 forming a guide supported by the sleds 7 of the drum cutter machine.

Figure 2:
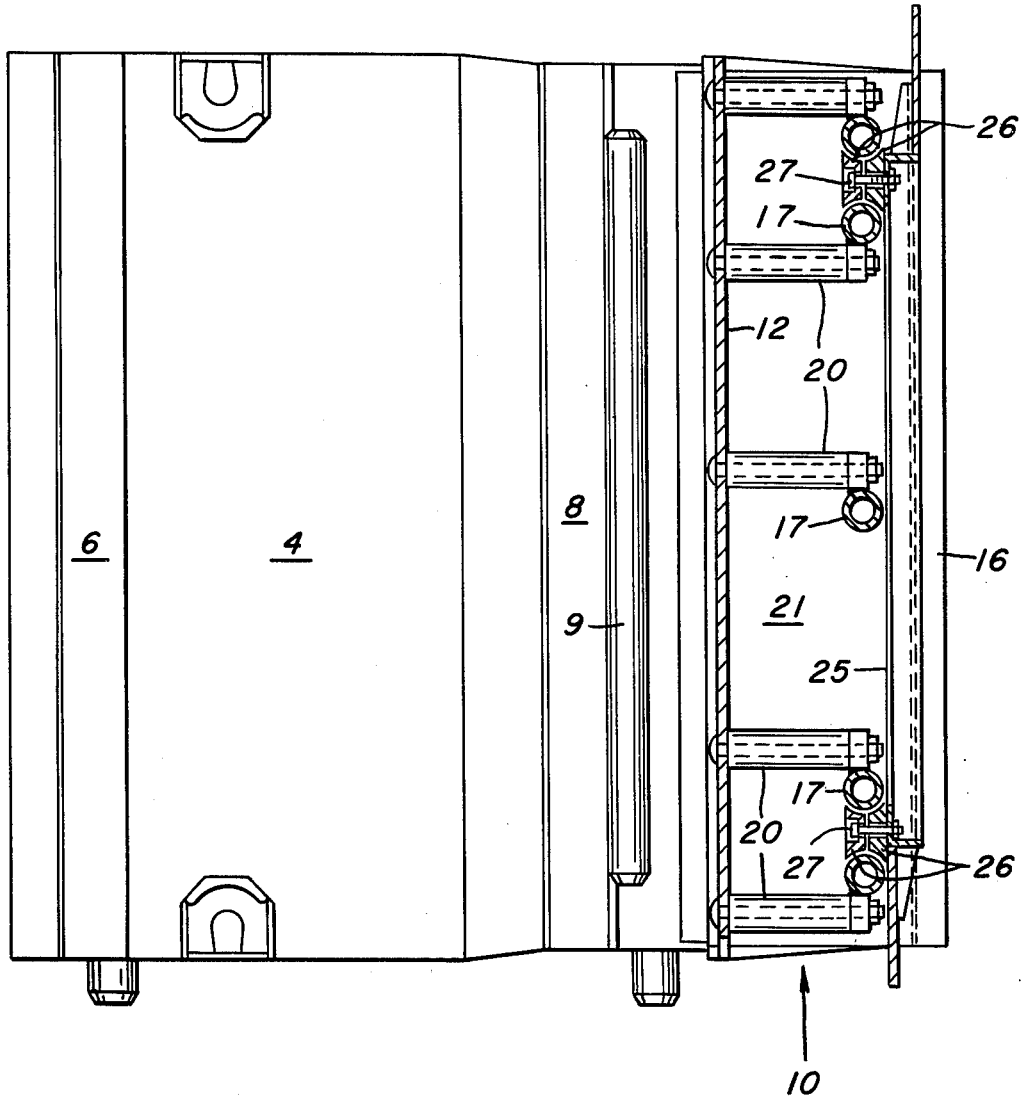
FIG. 2 is a sectional view taken along line II—II of FIG. 1.
Figure 3:
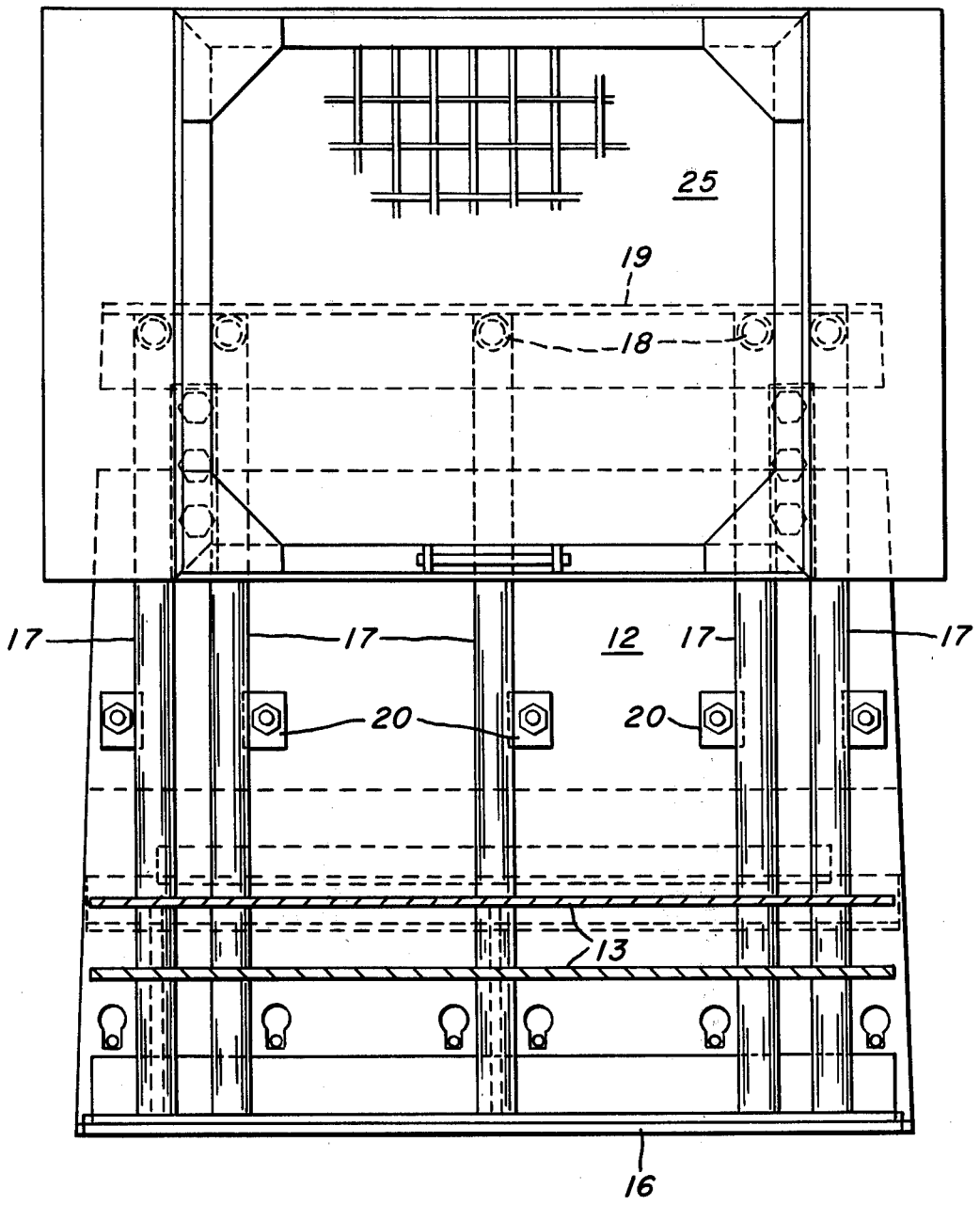
FIG. 3 is a side elevational view of the spill-plate housing shown in FIG. 1.

The angle trough 4 extends along the course of travel by the drum cutting machine 3 when releasing material from the mine face. This course of travel is defined, with respect to the stowing side, by a side spill-plate housing 10 which is detachably mounted onto the side wall 11 of the angle trough 4. The side spill-plate housing 10 includes a faceplate 12 extending along the length of the spill-plate housing and secured by bolts or the like to the side wall 11 of the angle trough 4. Two rib plates 13 extend along the length of the faceplate 12 and project horizontally from the bottom thereof. A thrust member 14 is secured to the outer edges of the rib plates 13. The thrust member 14 is engaged by a pushing cylinder forming part of a support system, not shown, employed for underground mining operations. Aligned annular bores 15 are formed in rib plates 13 at spaced-apart locations along the length thereof. A pipe 17 extends from a bottom plate 16 forming part of the spill-plate housing through bores 15 and projects upwardly at a spaced, parallel relation with the faceplate 12. The pipes 17 project upwardly above the top edge of the faceplate 12 to an elevation at which the pipes include end members 18 extending at right angles toward the mine face 1. A U-shaped roof 19 is supported by the members 18 as well as the pipes 17. Subdividing the interior space in the spill-plate housing are detachable bushings 20 which form stiffening members for the faceplate 12 and span the distance therebetween. As clearly shown in FIGS. 1 and 2, the bushings 20 are secured by bolt and nut assemblies that extend between the faceplate 12 and brackets welded to the pipes 17.

In the spill-plate housing, a bottom space 21 accommodates an installation of fixed cables while a movable cutter cable section 23, for example, is guided in loop form together with a water duct 24 in the top space 22 within the spill-plate housing. Access to the interior of the spill-plate housing is gained from the stowing side, i.e., the side formed by pipes 17, through the space between the pipes. This space is also employed to inspect the cables and water duct. It is preferred to enclose the interior space of the spill-plate housing by employing a vertically-adjustable door 25 having a woven grid-like fence. For this purpose, the pipes 17 are situated in pairs along the length of the spill-plate housing. Pairs of clamping members 26 are each provided with two annular surfaces for engaging the pipes and project between a pair of pipes 17. Each pair of clamping members 26 is secured together by a nut and bolt assembly 27 which is torqued to provide a desired gripping force on the pipes by the clamping members. In this way, the door 25 is vertically positioned as desired by torquing the nut and bolt asslemblies 27. The spill-plate housing can either be closed by the door at the stow side or the door can be locked in an open position to expose the interior of the spill-plate housing.

Figure 4:
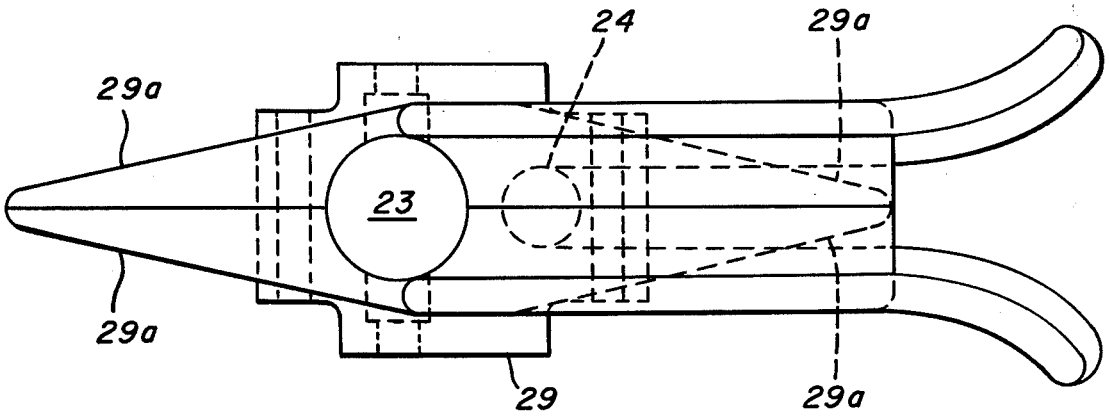
FIG. 4 is an enlarged detail view of the carrier extending from the mining machine into the spill-plate housing.

A carrier 29 is supported by an projects from the drum cutter machine 3 through a slot 28 located in the working face side of the spill-plate housing. In this regard, the slot 28 is defined by the top edge of the faceplate 12 and by the bottom edge of the roof 19. Carrier 29 is employed to guide the end of the cutter cable 23 as well as the end of the water duct 24 out of the interior space in the spill-plate housing into the casing forming the drum cutter machine 3. As clearly shown in Fig. 1, a resilient strip 30, for example, a strip of rubber-like material, is made into two parts to cover the slot 28 in the spill-plate housing 10. This resilient strip prevents the penetration of material released from the mine face into the interior of the spill-plate housing. The upper part 30A of the resilient strip takes the form of an apron strip which is secured to the vertical face portion of the roof 19. A bottom part 30B of the resilient apron strip is secured along the top face portion of the faceplate 12. The resilient apron strip parts 30A and 30B are constructed so that they extend along the length of the slot 28 and provide longitudinal edges which abut in the middle of the slot. In this way, the carrier 29 passes without obstruction into the interior 22 of the spill-plate housing. However, the slot 28 remains closed even at the place where the cable 23 emerges from the spill-plate housing. As clearly shown in FIGS. 1, 4 and 5, the carrier 29 includes tapering chamfered surfaces 29A extending in opposite directions corresponding to the direction of travel by the drum cutter machine. The surfaces 29A lie in the plane of the apron strip 30 to elastically deform the strip while maintaining a seal for the interior space in the spill-plate housing.

Figure 5:
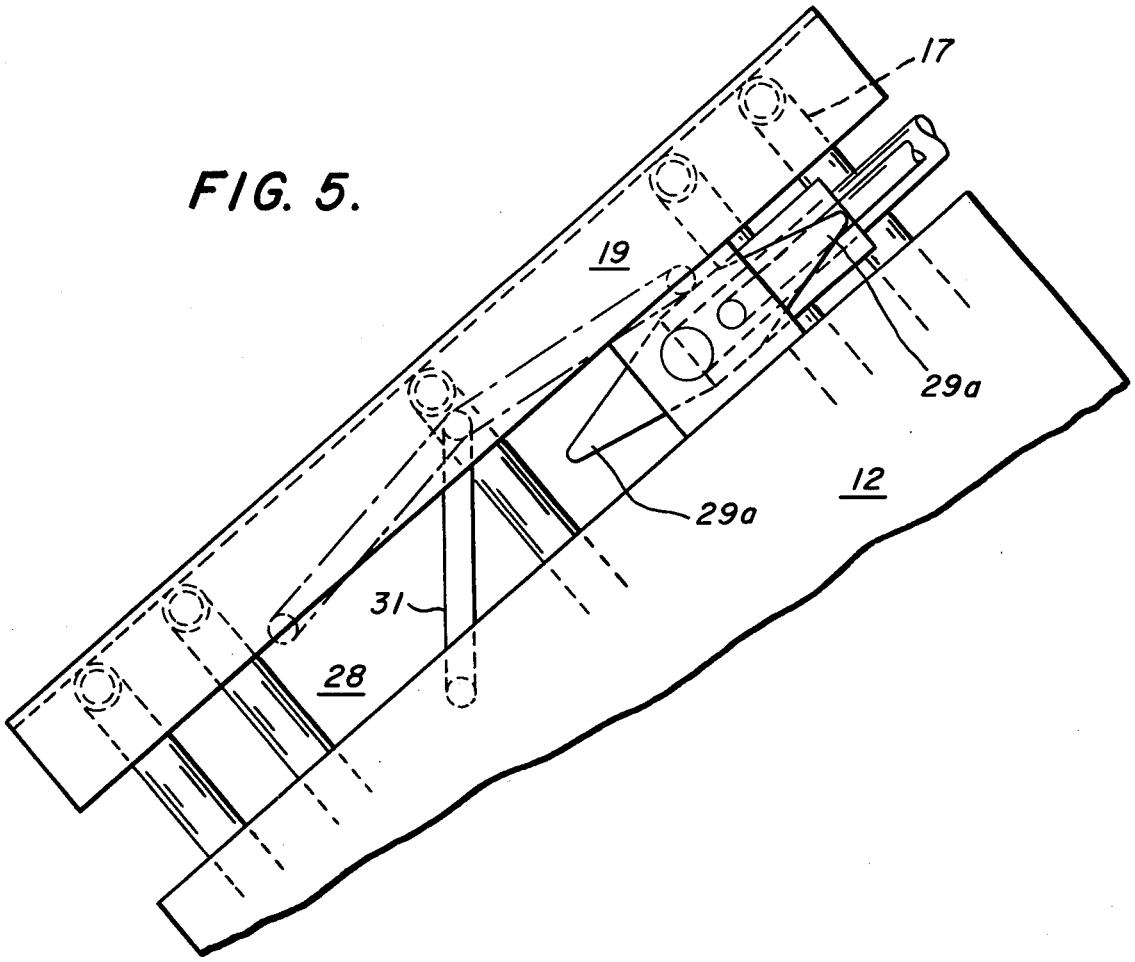
FIG. 5 is a front elevational view taken along line V—V of FIG. 1.

Blocking elements 31 are pivotally suspended from the roof 19 to extend into the interior space 22 of the spill-plate housing. These blocking elements obstruct the slot 28 for preventing unintentional emergence of the cable 23 and the water duct 24 from the interior of the spill-plate housing. When the drum cutter machine 3 travels along the mine face, the blocking elements are lifted in succession by a projection from the carrier 29 above the top edge of the slot 28 to the position shown by dot-dash lines in FIG. 5. In this way, the blocking elements do not obstruct travel by the drum cutter machine 3. After the carrier 29 passes beyond a blocking element, it is free to move by a pivotal motion back to its initial position. Each blocking element is biased by means of springs or a predetermined weight distribution so that, as can bre seen in FIG. 5, the blocking elements always assume a vertical position notwithstanding inclined positions to the spill-plate housing which occur when the mining operation is proceeding along a seam having a substantial inclination such as illustrated in FIG. 5. The blocking elements are dimensioned so that they extend in the vertical position to bridge the slot 28 along its entire height even when the spill-plate housing 10 is inclined at relatively steep angles.

It will be understood, of course, that when the cutter cable 23 is employed together with a cable chain, the blocking elements 31 may be dispensed with provided that the vertical dimensions of the cable chains surrounding the cutter cable are greater than the height of the slot 28.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. A spill-plate apparatus adapted to extend along one side of the course of travel by a mining machine having cutter means for releasing material from a mine face, said apparatus including the combination of:

a cable having an end connected to said mining machine while the cable extends along the course of travel by the mining machine, a spill-plate housing projecting along the course of travel by the mining machine, said housing having an internal space adapted to accommodate at least a portion of the extended length of said cable, said spill-plate housing including a face-plate with a longitudinal slot along the length of said housing and facing toward said mining machine, a carrier extending between the internal space in said housing and said mining machine for supporting the length of said cable extending through the slot in said faceplate, and shutter means normally closing said slot in the faceplate for preventing the passage of material released from the mine face into the internal space of said spill-plate housing, said shutter means being adapted to accommodate said carrier to move along said slot while extending into said spill-plate housing from said mining machine.

2. The apparatus according to claim 1 further comprising movable means supported at spaced-apart locations along the length of said housing for movement between blocking and non-blocking relations to the slot in said faceplate to prevent unintentional emergence of said cable from the slot in said housing.

3. The apparatus according to claim 2 wherein said movable means includes spring-biased blocking elements pivotally supported by said housing at spaced-apart locations along the extended length thereof.

4. The apparatus according to claim 2 wherein said movable means includes gravity-biasing blocking elements pivotally supported by said housing at spaced-apart locations along the extended length thereof.

5. The apparatus according to claim 1 further comprising blocking elements supported within the internal space of said housing by said faceplate for pivotal movement within a plane extending along the longitudinal direction of the slot in said housing.

6. The apparatus according to claim 5 wherein said blocking elements are suspended from said faceplate above said slot therein in a manner to traverse the slot while said housing projects along the angle of inclination by the mine face.

7. The apparatus according to claim 1 wherein said spill-plate housing includes a roof forming with said faceplate a seal against penetration by material released from the mine face.

8. The apparatus according to claim 1 wherein said shutter means includes a resilient apron strip secured to said faceplate to extend along said slot therein for sealing said slot against the passage of material released from the mine face, said apron strip being resiliently deformed by said carrier extending from said slot.

9. The apparatus according to claim 8 wherein the surface of said faceplate facing toward said mining machine receives and supports said resilient apron strip.

10. The apparatus according to claim 8 wherein said carrier includes tapering chamfered surfaces extending from opposite sides thereof in the longitudinal direction of said slot for elastically deforming said resilient apron strip.

11. The apparatus according to claim 1 wherein said shutter means includes upper and lower resilient apron strips secured to said faceplate above and below said slot therein in a manner such that the projected longitudinal edges of said apron strips abut along the longitudinal center of said slot.

12. The apparatus according to claim 1 wherein said spill-plate housing further includes vertical support ribs spaced from said faceplate to define said internal space, a lower housing support carrying said ribs while extending from said faceplate outwardly from said ribs, upper horizontal ribs extending between said faceplate and said vertical support ribs, detachable spacer bushings extending between said faceplate and said vertical support ribs for subdividing the internal space of the spill-plate housing, and a housing roof supported by said upper horizontal ribs.

13. The apparatus according to claim 12 wherein said spill-plate housing further includes fencing door means, and guide members carried by said vertical support ribs for adjustably supporting said fencing door means.

14. The apparatus according to claim 13 wherein said vertical support ribs include pairs of closely spaced-apart pipes forming vertical guide spaces, and wherein said guide members include a clamp plate with pipe-engaging surfaces at opposite sides of the pairs of closely spaced-apart pipes, and fastening means for developing a clamping force between the oppositely-disposed clamping plates.

* * * * *